US010028558B1

(12) United States Patent
Dou

(10) Patent No.: US 10,028,558 B1
(45) Date of Patent: Jul. 24, 2018

(54) EXPANDABLE AND COLLAPSIBLE HANDBAG

(71) Applicant: Nancy Dou, San Francisco, CA (US)

(72) Inventor: Nancy Dou, San Francisco, CA (US)

(73) Assignee: Nancy Dou, Salem, NH (US)

( * ) Notice: Subject to any disclaimer, the term of this patent is extended or adjusted under 35 U.S.C. 154(b) by 0 days.

(21) Appl. No.: 15/154,843

(22) Filed: May 13, 2016

Related U.S. Application Data

(60) Provisional application No. 62/162,494, filed on May 15, 2015.

(51) Int. Cl.

| | |
|---|---|
| ***A45C 7/02*** | (2006.01) |
| ***A45C 7/00*** | (2006.01) |
| ***A45C 1/02*** | (2006.01) |
| ***A45C 13/00*** | (2006.01) |

(52) U.S. Cl.
CPC ..... *A45C 7/0022* (2013.01); *A45C 1/02* (2013.01); *A45C 7/02* (2013.01); *A45C 13/005* (2013.01)

(58) Field of Classification Search
CPC ..... A45C 7/0022; A45C 1/02; A45C 7/02; A45C 13/005
See application file for complete search history.

(56) References Cited

U.S. PATENT DOCUMENTS

| | | | | | |
|---|---|---|---|---|---|
| 1,120,955 | A * | 12/1914 | Martin | B65D 5/0005 | 220/8 |
| 1,212,948 | A * | 1/1917 | Hesse | B65D 21/086 | 220/8 |
| 1,344,408 | A * | 6/1920 | King | A45C 7/00 | 190/15 R |
| 1,346,220 | A * | 7/1920 | Lewis | A45C 11/20 | 220/324 |
| 2,907,487 | A * | 10/1959 | Harrington | A47B 88/90 | 220/8 |
| 5,547,052 | A * | 8/1996 | Latshaw | A45C 5/14 | 16/113.1 |
| 6,116,447 | A * | 9/2000 | Daoud | H02B 1/40 | 220/4.03 |
| 7,874,409 | B1 * | 1/2011 | Lakhal | A45C 7/00 | 190/103 |
| 8,668,123 | B2 * | 3/2014 | Richmond | A45C 11/00 | 224/312 |
| 9,038,679 | B2 * | 5/2015 | Marquez-Bottome | A45C 13/002 | 150/103 |

* cited by examiner

*Primary Examiner* — Tri Mai
(74) *Attorney, Agent, or Firm* — Fish & Richardson P.C.

(57) ABSTRACT

A handbag, such as a clutch, includes a cover assembly that is openable at a top of the clutch. The cover assembly includes first section providing a first side of the clutch and a second section providing an opposite second side of the clutch. The first section is connected to the second section at least along a bottom of the clutch. Each section a proximal portion and a distal portion slidably attached to the proximal portion and positioned farther from the bottom of the clutch than the proximal portion. The distal portion is slidably attached to the proximal portion such that the section is expandable away from and collapsible toward the bottom of the clutch.

17 Claims, 9 Drawing Sheets

EXPANDABLE AND COLLAPSIBLE HANDBAG

CROSS-REFERENCE TO RELATED APPLICATIONS

This application claims priority to U.S. Application Ser. No. 62/162,494, filed on May 15, 2015, which is incorporated by reference.

TECHNICAL FIELD

This invention relates to an expandable and collapsible handbag, such as a box clutch or flap clutch.

BACKGROUND

As a personal accessory, a clutch is a thin handbag, typically rectangular but possibly oblong or square, with either no handle or a small primarily ornamental strap; the clutch is generally intended to be carried by holding its body (rather than a strap, if any). Three types of clutches include the box clutch, the flap clutch and the clasp frame clutch. A box clutch typically has two rigid halves that are connected on one edge by a hinge, and opens in a clamshell fashion. The flap clutch is similar to a rectangular purse, and is made of a more flexible fabric or plastic, and typically has a flap that covers an opening on the top of the clutch. The hinged clutch is also made of a more flexible fabric or plastic, but can be opened or closed along a top of the clutch by a hinge mechanism that permits the two top edges of the clutch to be moved away or toward each other. The zippered clutch is similar to the flap and hinged clutch, but can be opened or closed near a top of the clutch by a zipper.

SUMMARY

In one aspect, a clutch includes a cover assembly openable at a top of the clutch. The cover assembly includes first section that provides a first side of the clutch and a second section that provides an opposite second side of the clutch. The first section is connected to the second section at least along a bottom of the clutch. The first section includes a first proximal portion and a first distal portion slidably attached to the first proximal portion and positioned farther from the bottom of the clutch than the first proximal portion. The first distal portion is slidably attached to the first proximal portion such that the first section is expandable away from and collapsible toward the bottom of the clutch. The second section includes a second proximal portion and a second distal portion slidably attached to the second proximal portion and positioned farther from the bottom of the clutch than the second proximal portion. The second distal portion is slidably attached to the second proximal portion such that the second section is expandable away from and collapsible toward the bottom of the clutch.

Implementations may include one or more of the following features. A first bearing may connect the first proximal portion to the first distal portion, and a second bearing may connect the second proximal portion to the second distal portion. The first bearing and second bearing may be configured to provide linear motion between the proximal portions and distal portions along a height direction of the clutch. A third bearing may connect the first proximal portion to the second proximal portion, and a fourth bearing may connect the first distal proximal portion to the second distal portion. The third bearing and fourth bearing may be configured to provide linear motion between the first section and the second section along a width direction of the clutch. Each of the bearings may be a ball slide, linear bushing, drawer slide, rail slide, linear guide, scissor linkage or parallelogram linkage. The first bearing and second bearing may be the same kind of bearing and the third bearing and the fourth bearing may be the same kind of bearing. The first bearing may be a different kind of bearing than the third bearing. The first bearing and second bearings may be linear guides, and the third bearing and fourth bearing may be scissor linkages.

The first proximal portion may include a first proximal side panel and a first proximal cover, and the first distal portion may include a first distal side panel and a first distal cover. The first proximal side may be slidable in a recess in the first distal side panel away from and toward the bottom of the clutch.

The first proximal portion may include a first inner rail and a first inner cover, and the first distal portion may include a first outer rail and a first outer cover. The first inner rail may be slidable in a recess in the first outer rail away from and toward the bottom of the clutch. The second proximal portion may include a second inner rail and a second inner cover, and the second distal portion may include a first outer rail and a first outer cover. The first inner cover may be slidable in a slot in the first inner rail to be movable in a width direction of the clutch, and the first outer cover may be slidable in a slot in the first outer rail to be movable in the width direction of the clutch. An inner liner may be attached the first section and the second section. The inner liner may be softer than cover assembly and may be positioned in a volume between the first section and the second section to provide an interior volume of the clutch.

The first proximal portion may include a right inner rail, a left inner rail, and an inner fabric panel extending between the right inner rail and the left inner rail, and the first distal portion may include a right outer rail, a left outer rail, and an outer fabric panel extending between the right outer rail and the left outer rail. The right inner rail may be slidable in a channel in the right outer rail away from and toward the bottom of the clutch. The second proximal portion may include a second right inner rail, a second left inner rail, and a second inner fabric panel extending between the second right inner rail and the second left inner rail, and the second distal portion may include a second right outer rail, a second left outer rail, and a second outer fabric panel extending between the second right outer rail and the second left outer rail. The right inner rail and second right inner rail may be connected by a first double hinge, and the right outer rail and second right outer rail may be connected by a second double hinge.

The first distal portion and second distal portion may be slidably attached to the first proximal portion and second proximal portion, respectively, by a linear rail and track engagement. The first section may be expandable and collapsible along a direction perpendicular to the first side of the clutch. The first section may include a rail having a recess and a cover having a side wall that slidably fits into the recess. The first section may be movable toward and away from the second section such that the clutch is expandable and collapsible along a direction perpendicular to the first side of the clutch. The first section may be attached to the second section by a plurality of double hinges configured to maintain the first section and the second section in a substantially parallel arrangement as the first section moves toward and away from the second section. The clutch is a box clutch with the first section hingedly secured to the second section at the bottom of the clutch.

The first proximal portion, second proximal portion, first distal portion and second distal portion may be generally rigid bodies. The first distal portion may be slidable secured to the first proximal portion such that the first distal portion remains flush with the first proximal portion as the first section expands and collapses. A flap may be flexibly secured to the first section along the top of the clutch and positioned to be draped over a part of the second section and removably cover an opening between the first section and the second section at the top of the clutch. The first proximal portion, second proximal portion, first distal portion and second distal portion may include flexible sheets. The flexible sheet of the first distal portion may be connected to the flexible sheet of the second distal portion by a flexible portion that extends over the top of the clutch. A zippered opening or a hinged opening may be provided in the flexible portion that extends over the top of the clutch.

Potential advantages may include one or more of the following. The clutch is expandable along its height and/or width. This permits the clutch to be expanded so that larger personal items can be stowed in the clutch. For example, for a woman intending to wear high heeled shoes to a party, the clutch could be carried to a party in a collapsed state containing flat shoes. The flats can be removed from the clutch and the clutch can be expanded to store the heels, e.g., if her feet become sore. After use, the clutch can be returned to its collapsed state.

The details of one or more embodiments are set forth in the accompanying drawings and the description below. Other aspects, features, and advantages will be apparent from the description and drawings, and from the claims.

DETAILED DESCRIPTION

A clutch is often desirable as a fashionable handbag accessory for a formal event. Because the clutch is handheld, it is relative small and can carry only small personal items, e.g., makeup and the like. However, there are often occasions when the owner of the clutch would like to store a larger item. For example, high heeled shoes are also often fashionable for a formal event, but many women are not comfortable wearing heels for long periods of time and will remove their heels during the event. As a result, the heels are often left under a chair or table during the event or need to be carried home separately after the event. By making the clutch expandable, somewhat larger items, e.g., high heeled shoes and the like, can be stored in the clutch during and/or after the event, thus reducing the likelihood that the items will be lost and/or and increasing the ease of carrying the items after the event while retaining the aesthetic appearance.

Figure 1A:
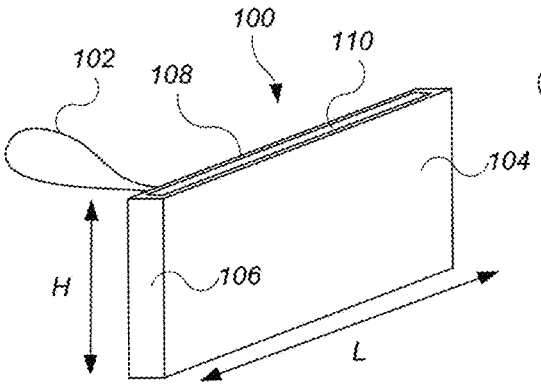
FIGS. 1A and 1B are schematic perspective views illustrating a clutch in collapsed and expanded states along its height, respectively.
Figure 1B:
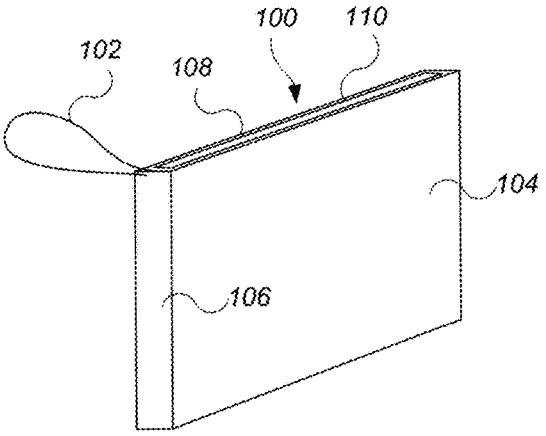
Figure 1C:
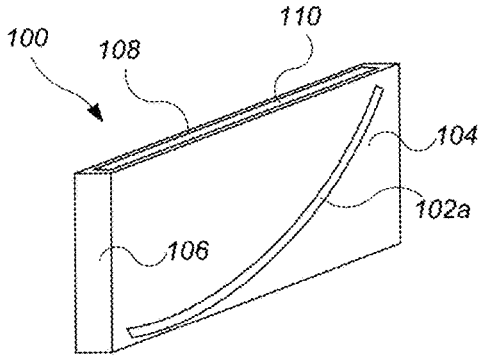
FIG. 1C is a schematic perspective view of a clutch with a strap across the front face.

Referring to FIG. 1A, a clutch 100 is a handbag with either no handle or a small primarily ornamental strap 102, e.g., suitable for wearing on a wrist rather than over a shoulder. Alternatively, as shown in FIG. 1C, a strap 102*a* can extend across the front surface 104 of the clutch so that the holder can place a hand between the strap 102 and front surface 104 to securely hold the clutch 100. The strap can extend from near one edge to another edge, e.g., from an upper corner to an opposite lower corner. Optionally, the clutch 100 can include a detachable shoulder strap that can clip to rings on the inside of the bag allowing the user to carry it like a purse when the clutch is expanded.

The clutch 100 includes two generally flat parallel side walls 106. A closable opening 110 is proved on the top 108 of the clutch or on the front surface 104 of the clutch near, e.g., in the upper 25%, the top of the clutch.

For the purpose of this disclosure, the "top" of a clutch 100 is the narrow side that would generally be held upright when the clutch is opened to access the interior. For example, the opening might be in the top of the clutch, or on the front surface near the top of the clutch 100. The "bottom" of the clutch is the side opposite the top, which remains closed.

In the case of a box clutch, the "bottom" would be the side with the hinged connection that permits the two halves to open to access the interior. In the case of a flap clutch, the "top" would be the side with the opening 110 that is covered by the flap 120 (see FIG. 1D), which can be flipped up to access the interior. And in the case of a clasp frame clutch, the "top" would be the side that can be opened by moving the edges 130 apart, e.g., using a double hinge 132 to access the interior (see FIG. 1E). In the case of a zippered clutch, the "top" would either the narrow side that can be unzipped with a zipper to provide an opening 104 to the interior, or if the zipper 140 is on the front surface 104 (see FIG. 1F), the longer narrow side (longer as compared to side walls 106) near the zipper.

Figure 1D:
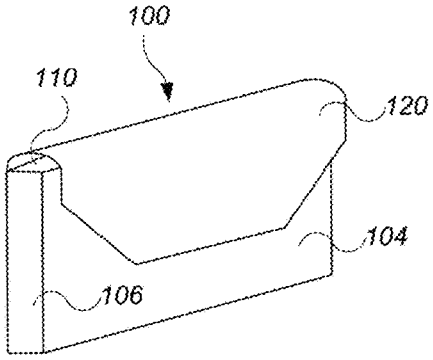
FIG. 1D is a schematic perspective view of a clutch with a flap.
Figure 1E:
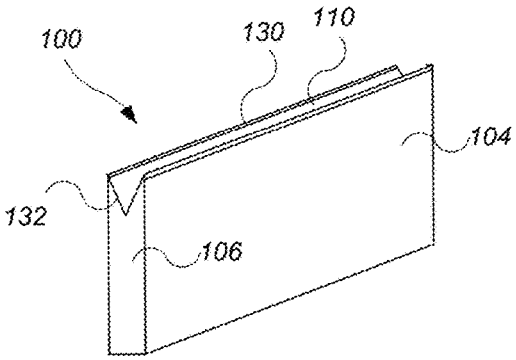
FIG. 1E is a schematic perspective view of a clutch with a hinged opening.
Figure 1F:
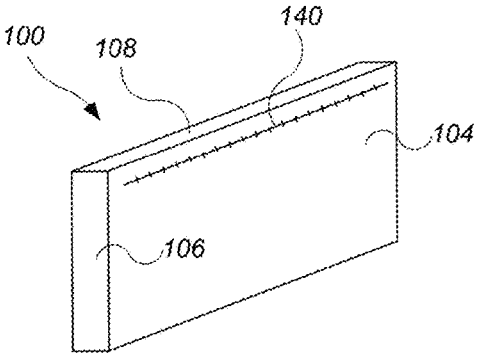
FIG. 1F is a schematic perspective view of a clutch with a zipper.

Of course, any of the implementations of FIGS. 1D-1E can be combined with any of the strap or strapless implementations.

The "height" of the clutch is the distance from the bottom to top of the clutch. Referring to FIGS. 1A and 1B, the clutch 100 is configured such that it is slidably expandable and collapsible along its height (H). The clutch can be opened and closed in either the expanded or collapsed position.

The "width" (W) of the clutch is the direction perpendicular to the height and length, whereas the "length" (L) of the clutch is the direction perpendicular to the height and width, with the width being direction in which the clutch is narrower when the clutch is in the closed and collapsed position. When the clutch is in a closed and collapsed position, the height can be greater than the width, but less than the length.

In some implementations, the clutch 100 is configured such that it is independently slidably expandable and collapsible along both its height and width, whereas in some implementations, the clutch 100 is configured such that it slidably expandable and collapsible along its height, but not along its width. In general, the clutch is not expandable along its length.

The clutch 100 can be generally shaped as rectangular parallelepiped, although other shapes are possible for the front and back surfaces, e.g., such as square or octagonal. Moreover, the edges and/or corners can be rounded, and/or the front and/or back surfaces can be convex surfaces.

For a clutch that is slidably expandable and its height, the clutch includes an upper (or proximal) portion that includes the top of the clutch, and a lower (or distal) portion that includes the bottom of the clutch. The upper portion is slidably connected to the lower portion by a bearing that permits linear motion of the two portions relative to each other, e.g., a ball slide, linear bushing, drawer slide, rail slide, linear guide, scissor linkage or parallelogram linkage.

In some implementations, particularly where the clutch is also expandable along its width, the clutch includes a first section that provides a first side of the clutch, e.g., the front side, and a second section providing an opposite second side of the clutch, e.g., the back side. The first section can include an upper portion and a lower portion, and similarly, the second section can include an upper portion and a lower portion. Thus, the casing of the clutch can be considered to be divided into four quarters.

For each section, the upper portion is slidably connected to the lower portion by a bearing. So a first bearing can be used to connect the upper portion to the lower portion for the first section, and a second bearing can be used to connect the upper portion to the lower portion for the second section. The same kind of bearing, e.g., ball slide, linear bushing, drawer slide, rail slide, linear guide, scissor linkage or parallelogram linkage, can be used to connect the upper portion to the lower portion for both the first and second sections.

A variety of positions are possible for the first and second bearings. For example, the first and second bearings can be linear rail bearings placed along and secured to the middle of the front and back sides of the casing of the clutch. As another example, the first and second bearings can be scissor linkages placed across the front and back sides of the clutch. As another example, the first and second bearings can be linear bearings placed along and secured to the thin side of the clutch.

Where the clutch is expandable along its width, the first (or front) section is slidably connected to the second (or back) section by a bearing that permits linear motion of the two portions relative to each other, e.g., a ball slide, linear bushing, drawer slide, rail slide, linear guide, scissor linkage or parallelogram linkage. Again, two bearings can be used to connect the front section to the back section, one for each of the upper and lower portions. So a third bearing can be used in the upper portion to connect the first section to the second section, and a fourth bearing can be used in the lower portion to connect the first section to the second section. The same kind of bearing, e.g., ball slide, linear bushing, drawer slide, rail slide, linear guide, scissor linkage or parallelogram linkage, can be used to connect the first section to the second section for both the upper portion and the lower portion.

A variety of positions are possible for the third and fourth bearings. For example, the third and fourth bearings can be linear rail bearings placed along and secured to the thin side of the clutch. As another example, the third and fourth bearings can be scissor linkages placed across the thin sides of the clutch. As another example, the third and fourth bearings can be linear bearings placed along and secured to the top and bottom sides of the clutch.

Figure 2:
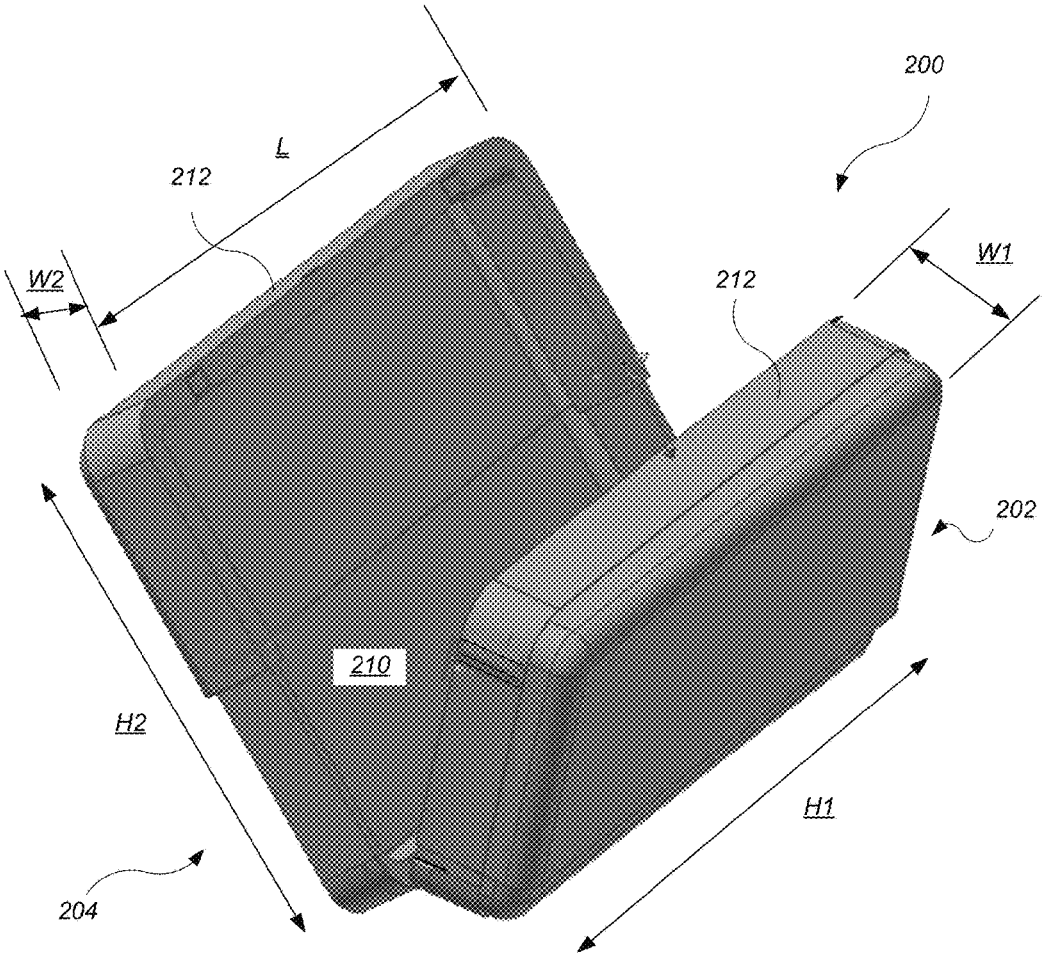
FIG. 2 is a perspective view of a box clutch with one side expanded along its height.

FIG. 2 illustrates an implementation of a box clutch 200 that is slidably expandable and collapsible along both its height and width. FIG. 2 shows the box clutch 200 partially open, and with one half shell in an expanded position. Box clutch 200 is an implementation of clutch 100 that can be opened as a clamshell.

Referring to FIGS. 2-4B, the box clutch 200 includes a front cover 202 and a back cover 204 attached to the front cover 202 by one or more hinges 205 (see FIG. 3) along bottom edges 206, 208 of the covers 202, 204, respectively. The hinges 205 permit the covers 202, 204 to swing open for access the interior 210 of the box clutch 200. Each cover 202, 204 can be generally shaped as rectangular parallelepiped that is open on the interior side, although other shapes are possible, such as square or octagonal, and each cover can have curved corners and edges.

A lock 212, such as a clasp, at the top of the covers 202, 204, can be used to releasably hold the covers 202, 204 in a closed position.

In the implementation shown in FIGS. 2-4B, the front cover 202 and the back cover 204 are constructed in a substantially similar fashion, merely mirror imaged across the center plane of the clutch. However, this is not necessary, e.g., the back cover could be shallower than the front cover.

In addition, in the implementation shown in FIGS. 2-4B, each cover 202 and 204 is independently slidably expandable and collapsible along both their height (H1, H2) and width (W1, W2) directions. However, in some implementations only one cover is expandable and collapsible along both its height and width directions; the other cover is expandable and collapsible only along its height direction.

Figure 3:
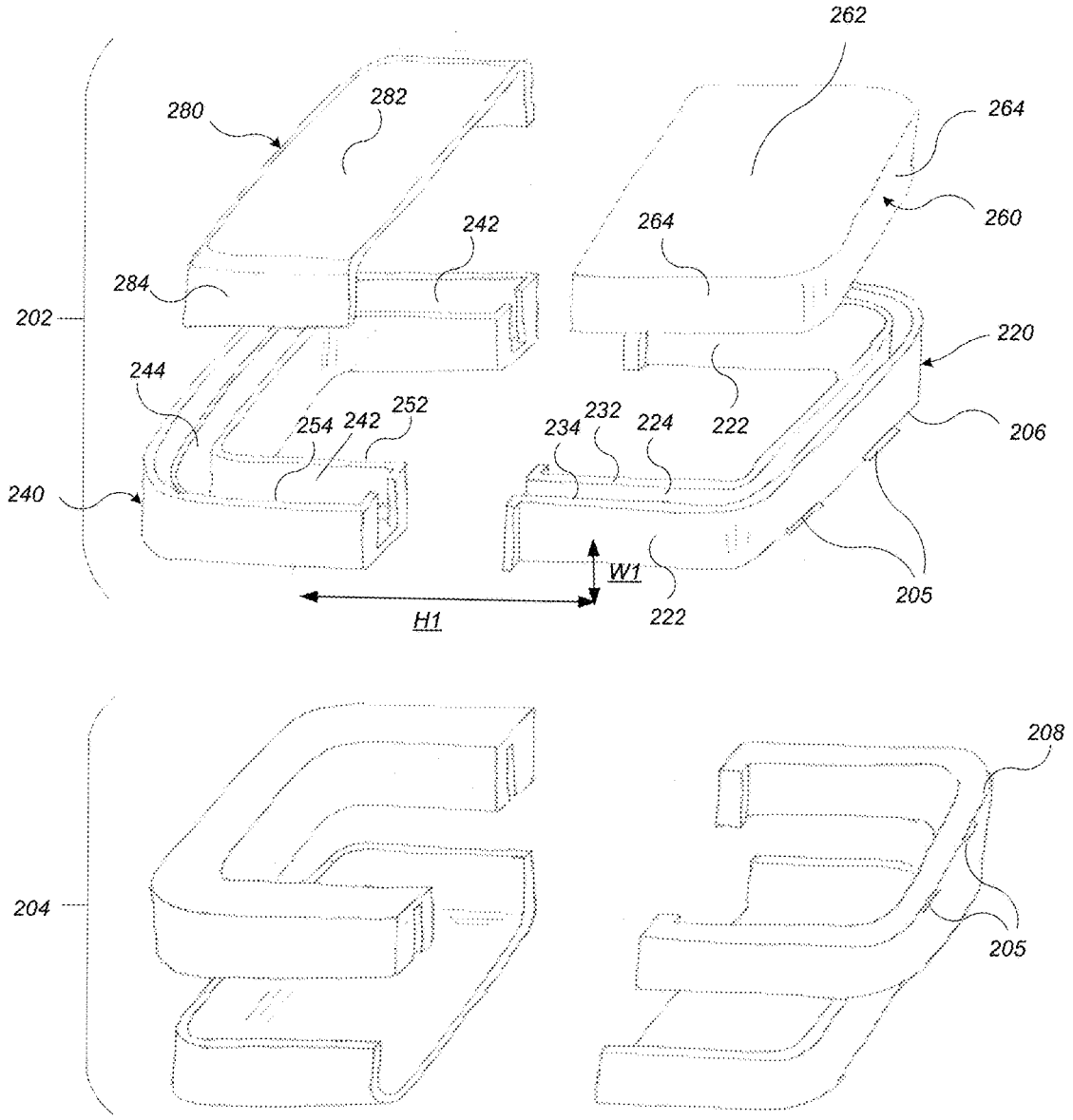
FIG. 3 is a schematic exploded perspective view of the box clutch.
Figure 4A:
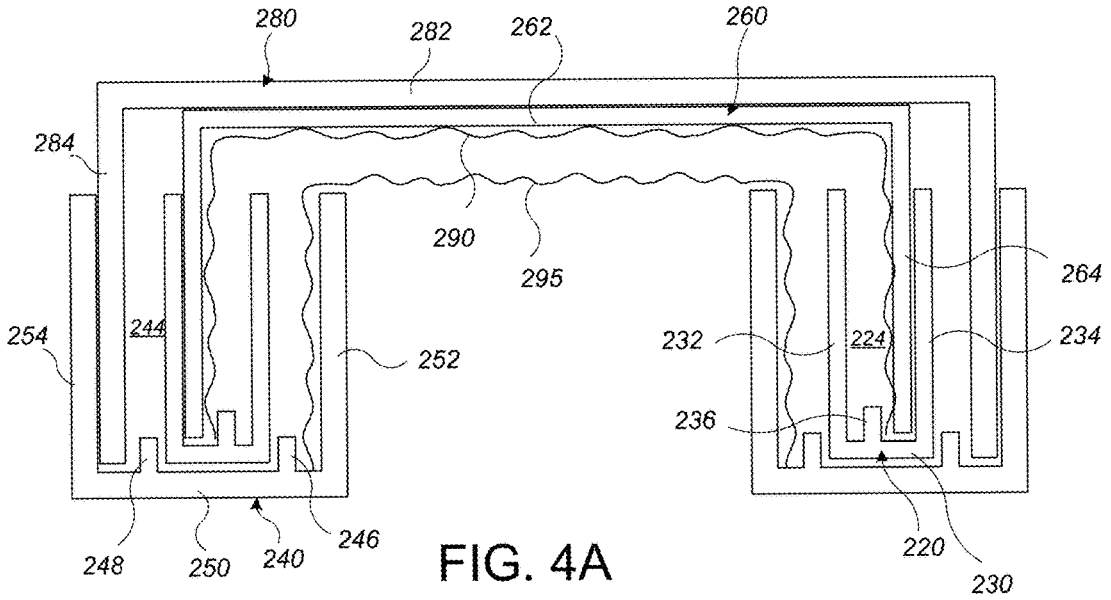
FIGS. 4A and 4B are schematic cross-sectional side views of one cover from the box clutch in collapsed and expanded states along its width, respectively.

Referring to FIGS. 3 and 4A, each cover 202, 204 includes an inner rail 220, an outer rail 240, an inner cover 260, and an outer cover 280. The inner rail 220 includes the bottom edge 206, 208 of the cover to which the hinges 204 are attached. The outer rail 240 is slidably engaged with the inner rail 220 so as to be movable linearly along the height direction (H). For example, the inner rail 220 can include linear sections 222 that extend along the height direction (H) that fit into linear slots 242 in the outer rail 240 that also extend along the height direction. The linear sections 222 can slide linearly in the slots 242 to permit the cover to expand or collapse along the height direction.

In some implementations, when in the collapsed position, the inner rail 220 extends in the slot to just before the curved or angled section of the outer rail 240. Similarly, when in the collapsed position, the outer rail 240 extends along the inner rail 220 to just before the curved or angled section of the inner rail 240.

The inner cover 260 is slidably engaged with the inner rail 220 so as to be movable linearly along the width direction. For example, the inner cover 260 can include a primary inner panel 262 that is substantially flat, and a side panel 264 that projects substantially perpendicular to the primary inner panel 262 and wraps around three sides of the inner cover 260, i.e., the bottom, left and right sides.

The inner rail 220 extends along the same three sides as the side panel 264 of the inner cover 260, i.e., the bottom, left and right sides. The portions of the inner rail 220 that extend along left and right sides can provide the linear sections 222. A recess 224 is formed in a surface of the inner rail 220 closer to the primary inner panel 262 of the inner cover 262. The recess 224 can extend along substantially all of the outer rail 240.

For example, as shown in FIG. 4A, the inner rail 220 can include a floor 230, and an interior wall 232 and an exterior wall 234 that are spaced apart by the recess 224 (the interior wall is on the side closer to the interior 210 of the clutch 200). The interior wall 232 and the exterior wall 234 can both extend perpendicularly from the floor 230. The side panel 264 of the inner cover 260 fits into the recesses 224 in the inner rail 220. For example, an exterior surface of the side panel 264 can slidably contact an interior surface of the exterior wall 234.

Similarly, the outer cover 280 is slidably engaged with the outer rail 240 so as to be movable linearly along the width direction. For example, the outer cover 280 can include a primary outer panel 282 and a side panel 284 that extends generally perpendicular to the primary outer panel 282 and wraps around three sides over the outer cover 280, i.e., the top, left and right sides.

The outer rail 240 extends along the same three sides as the side panel 284 of the outer cover 280, i.e., the top, left and right sides. A recess 244 is formed in a surface of the outer rail 240 closer to the primary outer panel 282 of the outer cover 262. The recess 244 can extend along substantially all of the outer rail 240. The portions of the recess 244 that extend along the left and right sides of the outer rail 240 can provide the slots 242.

For example, as shown in FIG. 4A, the outer rail 240 can include a floor 250, and an interior wall 252 and an exterior wall 254 that are spaced apart by the recess 244. The interior wall 252 and exterior wall 254 can extend perpendicularly from the floor 250. The side panel 284 of the outer cover 280 fits into the recesses 244 in the outer rail 240. For example, an exterior surface of the side panel 284 can slidably contact an interior surface of the exterior wall 254.

Figure 4B:
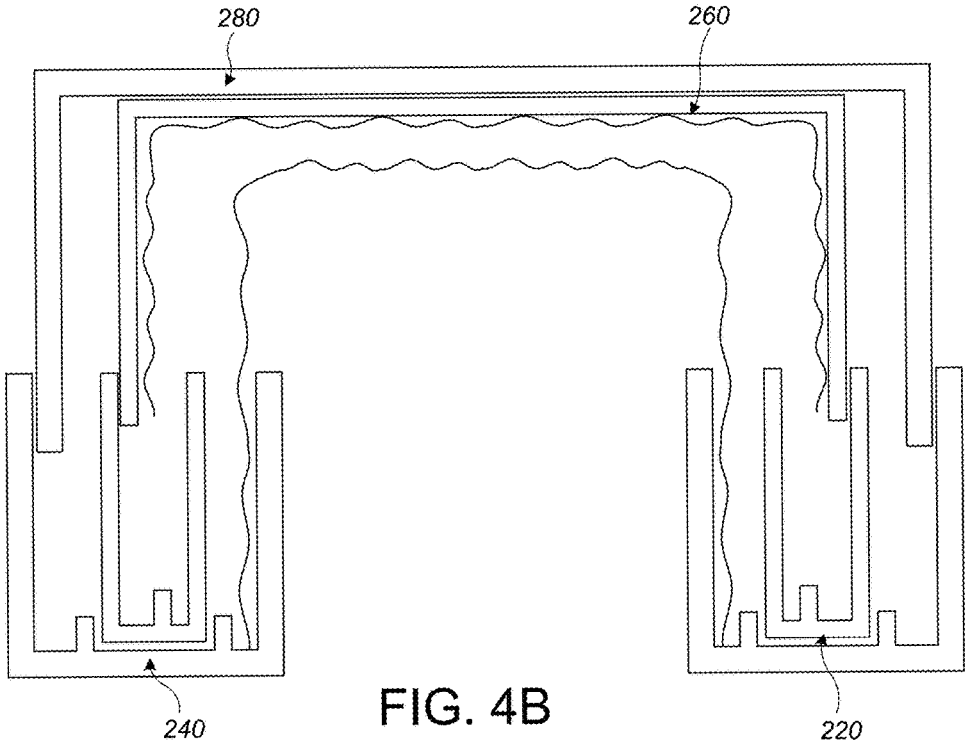

Referring to FIGS. 4A and 4B, to expand or collapse the cover 202 or 204 along the width direction, one merely slides the inner and outer covers 260, 280 out of or into the recesses 224, 244.

At least a portion of the inner cover 260 is covered by the outer cover 280. When the clutch is expanded along its height, the outer cover 280 slides with the outer rail 240 to exposed more of the inner cover 260. Conversely, when the clutch is collapsed along its height, the outer cover 280 slides with the outer rail 240 to cover more of the inner cover 260. An exterior surface of primary panel 262 of the inner cover 260 can slidably contact an interior surface of the primary panel 282 of the outer cover 280.

Each cover 202, 204 can additionally include one or more liners to provide the interior of the clutch 200 with a softer surface than the covers 202. Each cover 202, 204 can include an inner liner 290 that is secured to the inner cover 260 or to the inner rail 220, and an outer liner 295 that is secured to the outer rail 240. At least a portion of the inner liner 290 is positioned between the inner cover 260 and the outer liner 295. When the clutch is expanded along its height, the outer liner 295 slides with the outer rail 240 to exposed more of the inner liner 290. Conversely, when the clutch is collapsed along its height, the outer liner 295 slides with the outer rail 240 to cover more of the inner liner 290.

The inner liner 290 and outer liner 295 can each be a flexible cloth or plastic.

The inner liner can be secured, e.g., adhesively, to the interior surfaces of the panel 262 and sidewall 262 of the inner cover 260.

In some implementations, the inner rail 220 includes a projection 236 that extends upwardly from the floor 230 of the inner rail 220 and runs parallel but spaced apart from the walls 232 and 234. In the collapsed width position, the side panel 264 of the inner cover 260 can fit between the projection 236 and the exterior wall 234.

In some implementations, the outer rail 240 includes a first projection 246 and a second projection 248 that each extend upwardly from the floor 250 of the outer rail 240 run parallel but spaced apart from the walls 252 and 254 and each other. The first projection 246 can be positioned closer to the interior of the clutch than the second projection 248. In the collapsed width position, the side panel 284 of the outer cover 280 can fit between the second projection 248 and the exterior wall 254. The inner rail 220 can fit between the first second projection 248 and the first projection 246. For example, the exterior surface of the exterior wall 234 can be in sliding contact with the interior surface of the second projection 248, and the interior surface of the interior wall 232 can be in sliding contact with the exterior surface of the first projection 246.

The edges of the outer liner 295 can be secured to the outer rail 240 in a gap between the first projection 246 and the interior wall 252. The liner 295 can have an excess portion that fits into the gap between the interior wall 252 and the interior wall 232, such that the liner can expand when the clutch is extended along the width direction.

Figure 6:
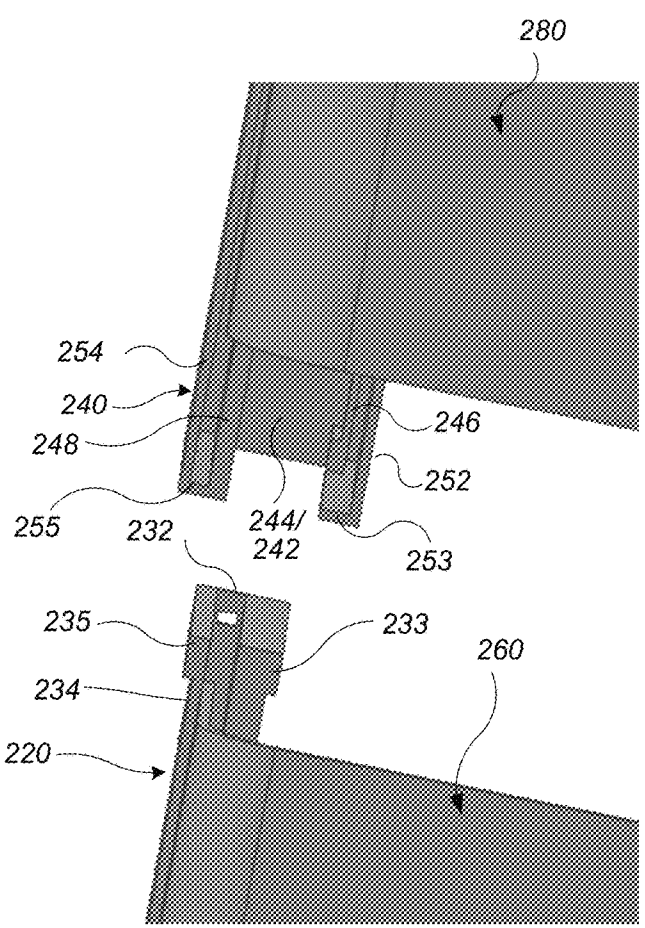
FIGS. 5 and 6 are schematic perspective views of an inner rail and an outer rail of the box clutch.
Figure 5:
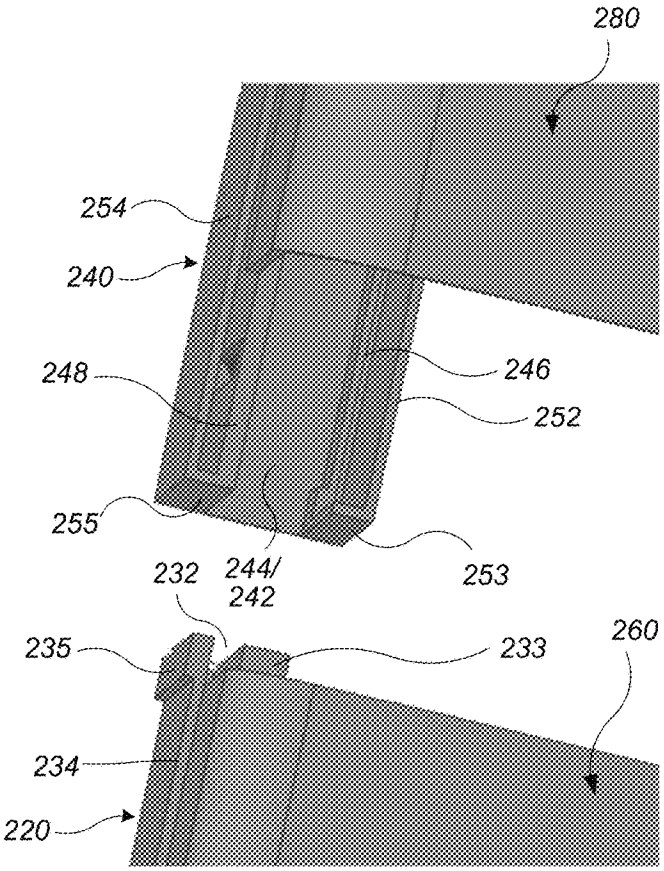

Referring to FIGS. 3, 5 and 6, the inner rail 220 and the outer rail 240 can include a stop mechanism to prevent over-extension of the rails and prevent the inner rail 220 from sliding out of the slot 242 in the outer rail 240. For example, the inner rail 220 can include a projection that catches against a corresponding stop of the outer rail 240. FIGS. 5 and 6 illustrate the inner rail 220 as detached from the outer rail 240, but in use at least a portion of the inner rail 220 would fit into the slot 242 in the outer rail 240.

In some implementations, each end of the interior wall 232 of the inner rail 220 can include an projection 233 that extends in toward the interior of the clutch, and each end of the interior wall 252 of the outer rail 240 can include a projection 253 that extends toward the exterior wall 254, and partially closing off the slot 244. Alternatively or in addition, each end of the exterior wall 234 of the inner rail 220 can include an projection 235 that extends away from the interior of the clutch, and each end of the exterior wall 254 of the outer rail 240 can include a projection 255 that extends toward the interior wall 252, and partially closing off the slot 244. When the cover is expanded along the height direction, the projection 233 catches against the projection 253 and/or the projection 235 catches against the projection 255 to prevent the inner rail 22 from sliding out of the slot 242.

As an alternative or in addition to the stop mechanism shown in FIGS. 3, 5 and 6, expansion of the clutch along the height direction can be limited by springs or strings that fit in the recess 244, with opposite ends of the springs or strings connected to the inner rail 222 and outer rail 220 and outer rail 240, respectively. Also, an alternative or in addition to the above, the clutch could include a set of teeth on one of the rails to engage a catch on the other rail and hold the rails in fixed vertical position relative to each other. The catch can be actuated by a button to disengage from the teeth so that the two rails are movable relative to one another.

Although FIG. 3 illustrates the inner rail 220 as having a uniform width, in some implementations, the portions of the right and left sides of the inner rail 220 that are covered by the outer rail 250 when the cover is in the collapsed position are thinner (in the width direction) by an amount equal to the thickness of the floor 250 of the outer rail 240. This permits the rims of the front cover 202 and back cover 204 to abut each other along their entire length when the covers is in the collapsed position.

In some implementations, the inner rail 220 is connected to the inner cover 260 by a spring that biases the inner cover outwardly into contact with primary panel 282 of the outer cover 280.

In some implementations, the outer rail 240 is connected to the outer cover 280 by a double hinge or a spring that prevents the outer cover 280 from slipping out of the recess 244 in the outer rail 240. The double hinge or spring can fit in the space between the exterior wall 234 of the inner rail 220 and the side panel 284 of the outer cover 280.

Figure 7:
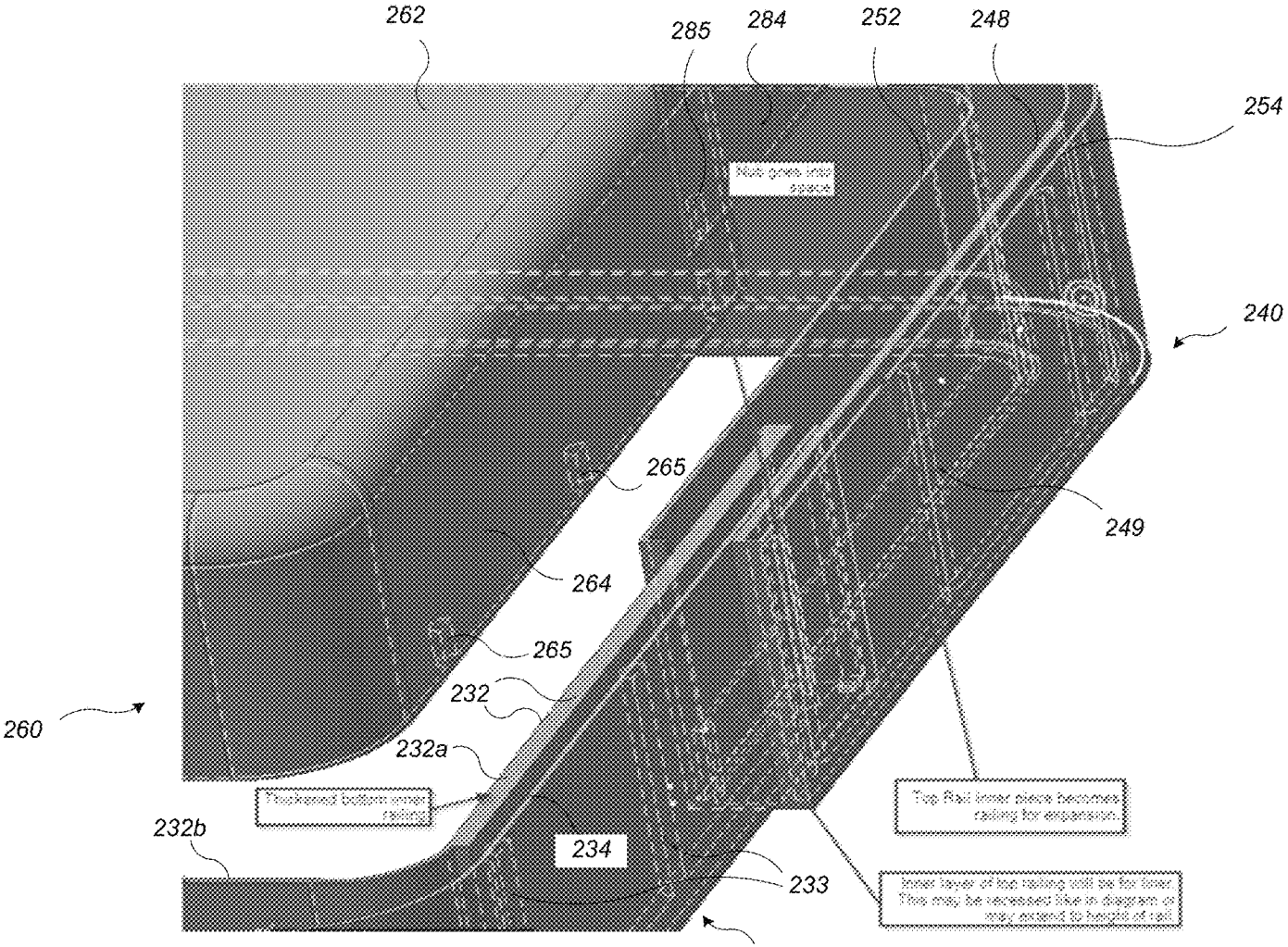
FIG. 7 is a perspective exploded view of another implementation of the box clutch.

FIG. 7 illustrates an implementation of the clutch 200 in which, in the outer rail 240, the projection 248 extends up to the same height as the side walls 252 and 254. A plurality of recesses 249 that extend along the width direction can formed on the exterior surface of the projection 248 (only one is clearly visible in FIG. 7, but additional recesses can be formed in the top and opposite portions of the side walls) in the outer rail 240. Similarly, a plurality of recesses 233 that extend along the width direction can be formed on the exterior surface of the interior wall 232 of the inner rail 220. Optionally, the inner wall 232 of the inner rail 220 can include a section 232*a* along the left and right sides that is thicker than the bottom section 232*b* of the inner rail 220 to accommodate the depth of the recesses. Although the recesses 249, 233 are illustrated as semicircular, other cross-sections such as rectangular are possible.

A plurality of inwardly extending projections 285 can be formed on the interior surface of the side panel 284 of the outer cover 280 (again, only one is clearly visible in FIG. 7, but additional projections can be formed in the top and opposite portions of the side panel). Similarly, a plurality of inwardly extending projections 265 can be formed on the interior surface of the side panel 264 of the inner cover 260. The projections 265, 285 can have a cross-sectional shape complementary to the recesses 233, 249, respectively.

Once assembled, the projections 265, 285 fit into the recesses 233, 249, respectively, to provide a linear sliding mechanism along the width direction. In addition, the recesses 233, 249 do not extend along the entire width of the rails 220, 240, respectively. Thus, the projections 265, 285 will catch against the ends of the recesses 233, 249, respectively, to limit expansion of the clutch along the width direction and prevent the covers 260, 280 from coming loose from the rails 220, 240.

Figure 8:
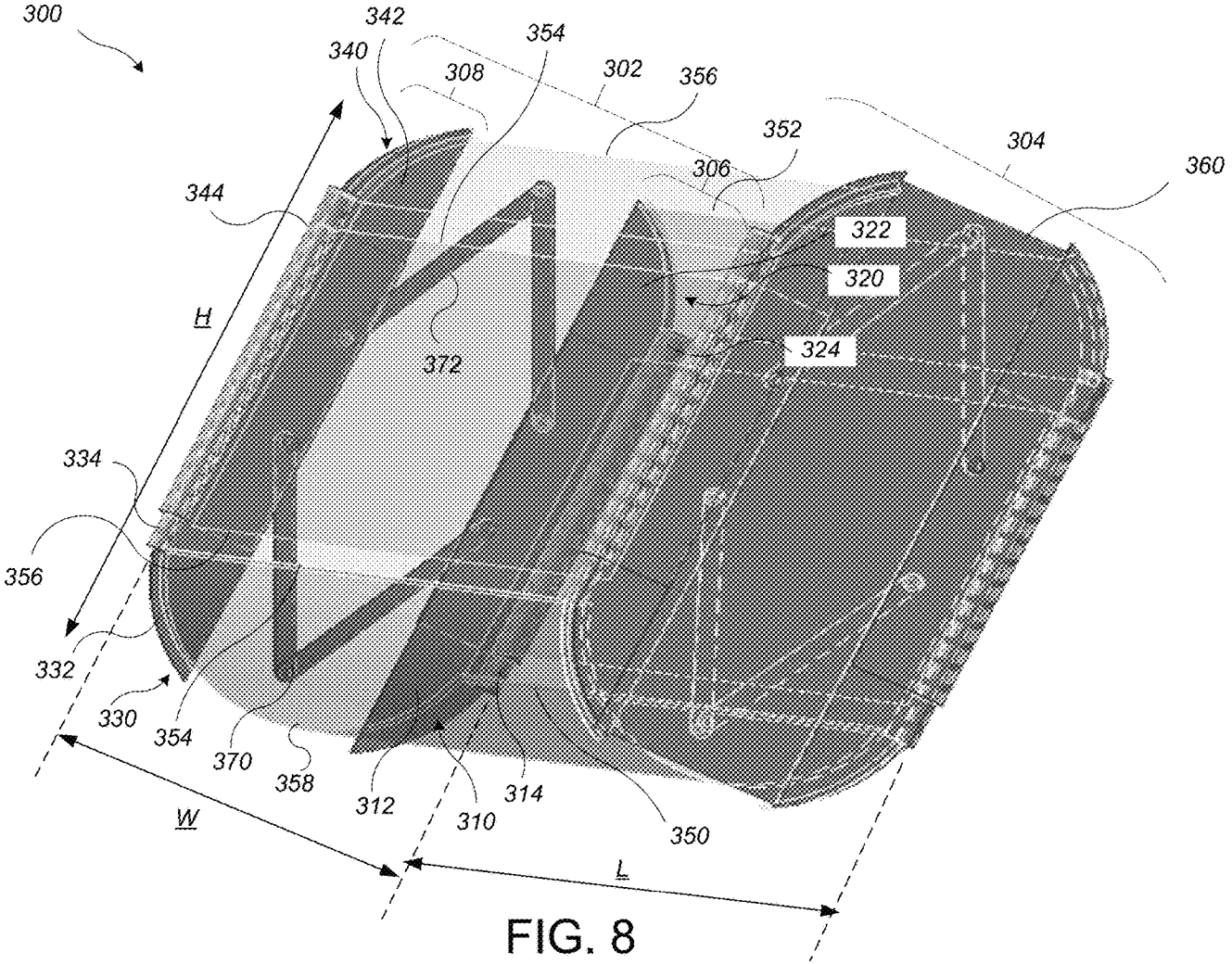
FIGS. 8 and 9 are perspective views of another implementation of a clutch in collapsed and expanded states along its height, respectively.
Figure 9:
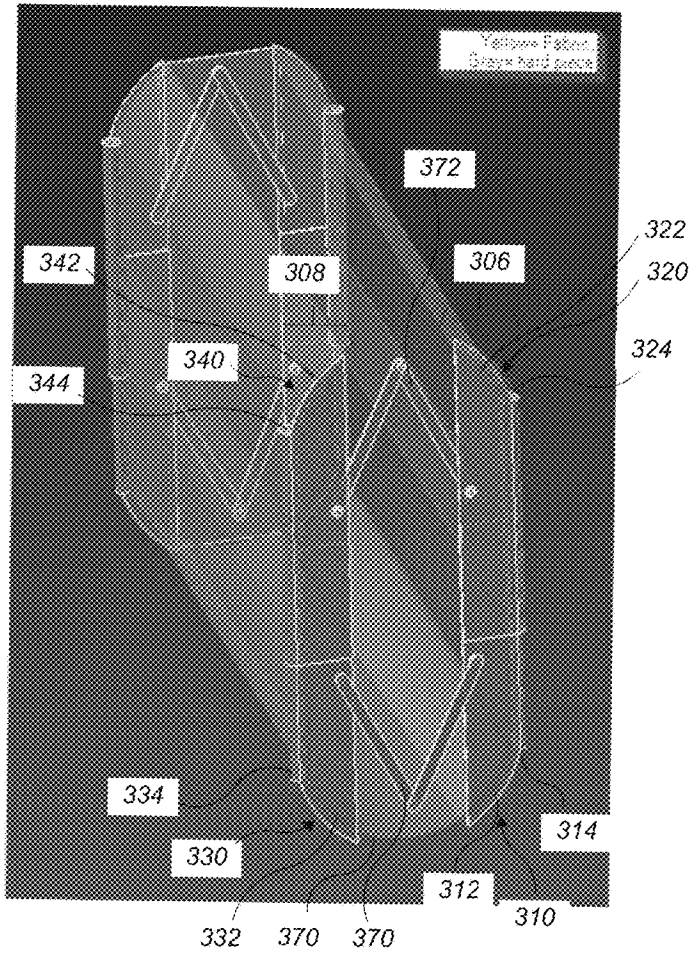

FIGS. 8 and 9 illustrate an implementation of a clutch 300 that is slidably expandable and collapsible along both its height and width. The clutch 300 is an implementation of the clutch 100 that is adaptable, as discussed below, as a fold, hinged or zippered clutch. FIG. 8 shows the clutch collapsed along its height direction, whereas FIG. 9 shows the clutch 300 expanded in its height direction.

The clutch 300 includes a left rail assembly 302 and a right rail assembly 304. The rail assemblies 302 and 304 are constructed in a substantially similar fashion, merely mirror imaged across the center plane of the clutch.

In addition, in the implementation shown in FIGS. 8-9, each rail assembly 302 and 304 is independently slidably expandable and collapsible along both their height (H1, H2) and width (W1, W2) directions.

Each rail assembly 302, 304 includes a front rail structure 306 and a back rail structure 308 that is secured to the front rail structure 308 by a mechanism that permits the rail structures 306, 308 to be moved closer or farther while maintain the rail structures 306, 308 in a generally parallel orientation. For example, the mechanism can include a pair of double hinges 370, 372, but other mechanism are possible such as tube sliders similar to those discussed below, or one face could slide on top of the other The front rail structure 306 includes a front inner rail 310 and a back outer rail 320 that is slidably engaged with the front inner rail 310 so as to be movable linearly along the height direction. Similarly, the back rail structure 308 includes a back inner rail 330 and a back outer rail 340 that is slidably engaged with the back inner rail 330 so as to be movable linearly along the height direction.

Figure 10:
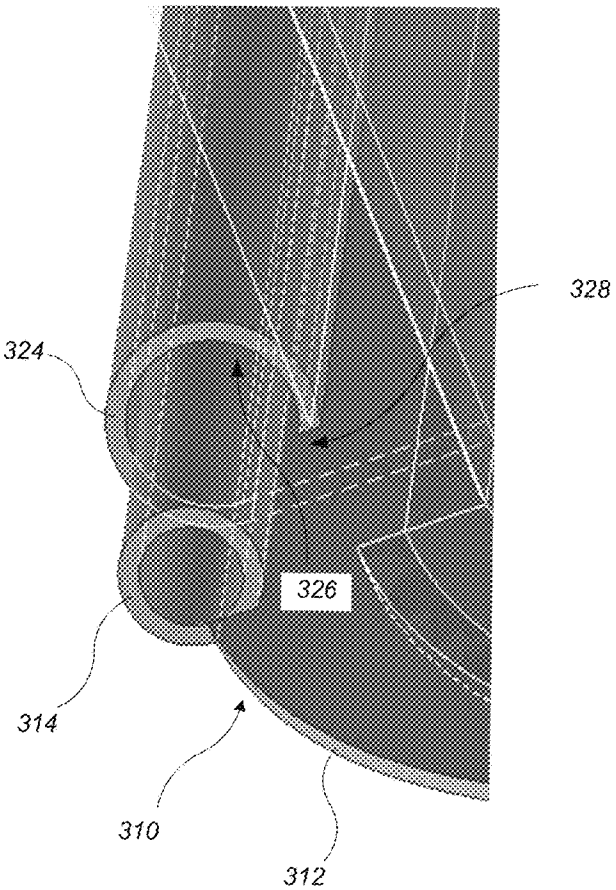
FIG. 10 is a close-up perspective view of a sliding mechanism from the clutch of FIGS. 8 and 9.

The front inner rail 310 includes a flat panel portion 312 and a rim portion 314, and the front outer rail 320 includes a flat panel portion 322 and a rim portion 324. As shown in FIG. 10, the rim portion 324 of the front outer rail 320 can form a channel 326 that extends height-wise along the front outer rail 320. The side of the rim portion 324 closer to the flat panel portion 322 can have a gap 328 that also extends height-wise along the front outer rail 320. The rim portion 314 of the front inner rail 310 can fit into and slide within the channel 326, with the flat panel portion 312 protruding through the gap 328, thus providing the linear sliding mechanism. In the implementation shown in FIG. 10, the rim portion 324 is curled to form most of a circle, so that the channel 326 is generally cylindrical, but other cross-sectional shapes, such as a polygon, are possible. Returning to FIGS. 8 and 9, an exterior surface of the flat panel portion 312 of the front inner rail 310 can slidably contact an interior surface of the flat panel portion 322 of the front outer rail 320.

The back inner rail 330 and back outer rail 340 are constructed similarly to the front inner rail and front outer rail. The back inner rail 330 includes a flat panel portion 332 and a rim portion 334, and the back outer rail 340 includes a flat panel portion 342 and a rim portion 344. The rim portion 334 of the back inner rail 330 can fit into and slide within a channel formed in the rim portion 344 of the back outer rail 340, and the flat panel portion 332 of the back inner rail 330 can protrude through a gap in the rim portion 344 closer to the flat panel portion 342. An exterior surface of the flat panel portion 332 of the front inner rail 330 can slidably contact an interior surface of the flat panel portion 342 of the front outer rail 340.

At least a portion of each inner rail 310, 330 is covered by the corresponding outer rail 320, 340. When the clutch is expanded along its height, each outer rail 320, 340 slides to expose more of the inner rail 310, 330. Conversely, when the clutch is collapsed along its height, each outer rail 310, 330 slides to cover more of the inner rail 320, 340.

The front inner rail 310 can be secured to the back inner rail 320 by a first double hinge 370, and the front outer inner rail 330 can be secured to the back outer rail by a first double hinge 372. The first double hinge 370 can be positioned to the interior the inner panels 312, 332, and the second double hinge 372 can be positioned to the exterior the inner panels 322, 342.

The front and back sides of the clutch 300 are each provided by a pair of panels formed of a material, e.g., a fabric or a plastic, that is softer than the rails. For example, the clutch 300 can include a front interior panel 350 secured to and extending between the front inner rails 310 of the left and right rail assemblies 302, 304, a front exterior panel 352 secured to and extending between the front outer rails 320 of the left and right rail assemblies 302, 304, a back interior panel 354 secured to and extending between the back inner rails 330 of the left and right rail assemblies 302, 304, a back exterior panel 356 secured to and extending between the back outer rails 340 of the left and right rail assemblies 302, 304. Each panel can be connected to the rail on or adjacent the rim portion of the rail.

At least a portion of each interior panel 350, 354 is covered by the corresponding exterior panel 352, 354. When the clutch is expanded along its height, each exterior panel 352, 356 slides to expose more of the interior panel rail 350, 354. Conversely, when the clutch is collapsed along its height, each exterior panel 352, 356 slides to cover more of the interior panel 350, 354.

Optionally, one or more struts formed of a rigid material, e.g., a rigid plastic, can connect the left and right rail assemblies 302, 304 to maintain the left and right rail assemblies 302, 304 in a laterally fixed position and keep the panels 350, 352, 354, 356 in tension. For example, a strut could extend between and connect the rims 324 of the front outer rails 320 of the left and right rail assemblies 302, 304. Such a strut could fit into a space between the interior panel 350 and exterior panel 352. Alternatively or in addition, a strut could extend between and connect the rims 344 of the back outer rails 340 of the left and right rail assemblies 302, 304. Such a strut could fit into a space between the interior panel 354 and exterior panel 356.

In some implementations, the front interior panel 350 and the back interior panel 354 are connected by another sheet of material that extends across the bottom of the clutch 300. For example, the front interior panel 350 and the back interior panel 354 can be provided by a single sheet of material. For example, this interior sheet can include a portion 358 that extends between bottom edges of the front interior panel 350 and back interior panel 354, and effectively provides the bottom boundary for the interior of the clutch 300. Optionally, the portion 358 can be pleated or have an accordion fold so as to stretch and shrink when the clutch 300 expands and collapses, respectively, along the width direction.

The right and left sides of the clutch 300 can each be provided by portions of the panels 312, 322, 332, 342, that are in a sliding arrangement. In this case, when the clutch is expanded along its width, one of the panels 312, 332 slides to expose more of the other panel, and one of the panels 322, 342 slides to expose more of the other panel. Conversely, when the clutch is collapsed along its width, one of the panels 312, 332 slides to cover more of the other panel, and one of the panels 322, 342 slides to cover more of the other panel. Alternatively, a separate panel 360 could fit between the front rail structure 306 and back rail structure 308, and the rail structure 306, 308 could slide to uncover or cover the panel 360 when the clutch is expanded or collapsed, respectively, along the width direction.

Alternatively or in addition, the right and left sides of the clutch 300 can covered by the same softer material as the interior and exterior panels. In this case, the side portions can have an accordion fold so as to stretch and shrink when the clutch 300 expands and collapses, respectively, along the width direction.

In some implementations, the clutch 300 is opened and closed by expanding and collapsing the clutch 300 along the width direction. In this case, when the clutch 300 is in the collapsed position, the upper edge of the front exterior panel 352 can contact the upper edge of the back exterior panel 356 to close the clutch.

In some implementations, when the clutch 300 is in the fully collapsed position, the upper edge of the front exterior panel 352 can remain spaced apart from the upper edge of the back exterior panel 356 to provide an opening to the interior of the clutch 300. As one example, a flap 120 (see FIG. 1D) is connected to the upper edge of the back exterior panel 356. The flap can hang over front interior panel 352, and be flipped up to provide access the interior of the clutch 300.

In some implementations, the front exterior panel 350 and the back exterior panel 354 are connected by another sheet of material that extends over the top of the clutch 300. For example, the front exterior panel 350 and the back exterior panel 354 can be part of a single sheet of material. Optionally, the sheet of material can be pleated or have an accordion fold so as to stretch and shrink when the clutch 300 expands and collapses, respectively, along the width direction. Access to the interior of the clutch can be provided by a zipper 110 (see FIG. 1F) to open or close an opening in the sheet of material at or near the top of the clutch 300. Alternatively, access to the interior of the clutch can be provided by an opening with reinforced edges and a hinge mechanism 132 (see FIG. 1E)—separate from the hinges 370, 372—that permit the edges of the opening in the sheet of material to be moved away or toward each other.

Although two implementations are described above, many other configurations are possible. For example, two linear guide bearings placed on the front and back faces of the clutch can be used to provide expansion and contraction along the height direction (i.e., sliding of the upper portion relative to the lower portion), and two scissor linkages placed on the top and bottom sides of the clutch can be used to provide expansion and contraction along the width direction (i.e., sliding of the front section relative to the back section). As another example, two linear guide bearings placed on the front and back faces of the clutch can be used to provide expansion and contraction along the height direction (i.e., sliding of the upper portion relative to the lower portion), and two parallelogram linkages placed on the thin sides of the clutch can be used to provide expansion and contraction along the width direction (i.e., sliding of the front section relative to the back section).

Springs can be used to bias the clutch into the expanded and/or contracted state. The springs can be compression springs, extension springs, torsion springs, or spring flexures. In some implementations, the springs can be secured to the clutch such that they provide a bi-stable configuration. That is, when the clutch is in the contracted state, the springs will bias the clutch to remain contracted, whereas when the clutch is in the expanded state, the springs will bias the clutch to remain expanded. For example, for each of the front and back faces of the clutch, two torsion springs can be connected to the upper section and lower section at points on the front and back face such that maximum compression of the spring occurs at a midpoint of expansion of the clutch along the height direction.

A latch can be used to hold the clutch in the expanded and/or contracted state. The latch can be squeeze-slam latch, drawbar slam latch, push-push latch or rotary latch.

In an example implementation, bi-stable springs are used to hold the clutch in the expanded and contracted states along the height direction, and a latch, e.g., a push-push latch, is used to hold the clutch in the expanded and contracted states along the width direction.

Although the implementations described above have one cover with a rail that fits entirely into a recess of a rail of another cover, this is not necessary. The two covers could simply be held in a sliding side-by-side arrangement. A projection from a side panel of one cover can fit into a linear recess in the side panel of another cover to provide stabilization.

Figure 11:
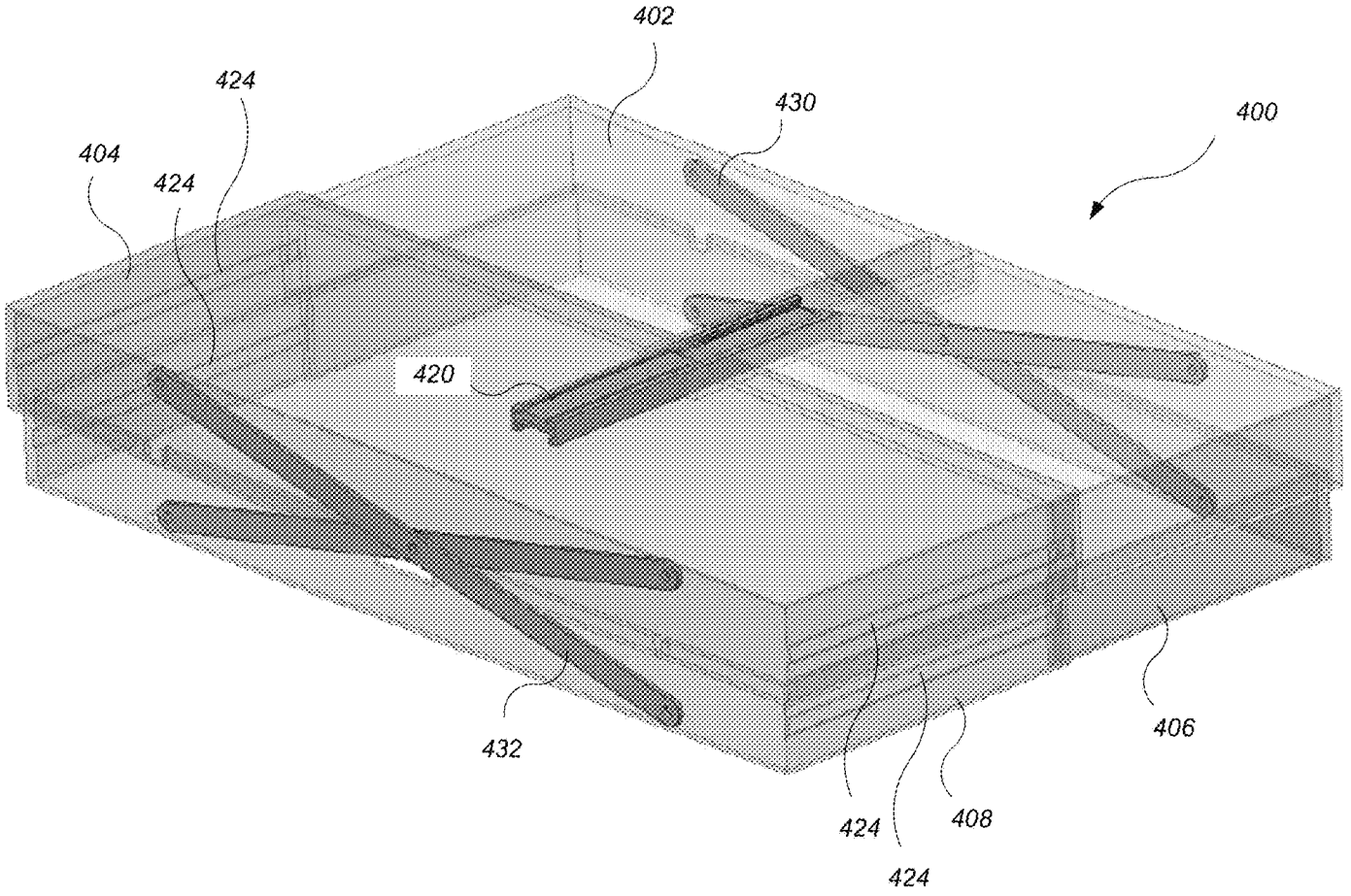
FIG. 11 is a schematic perspective view of a clutch.

FIG. 11 is a schematic perspective view of an implementation of a clutch 400 that combines some of the features discussed above. The clutch 400 includes four quarter-shell portions: a front proximal portion 402, a front distal portion 404, a back proximal portion 406 and a back distal portion 408.

A linear guide 420 secures the main cover of the front proximal portion 402 to the front distal portion 404, and a similar linear guide (not illustrated to avoid clutter in the drawing) secures the main cover of the back proximal portion 406 to the back distal portion 408, to provide expansion and contraction along the height direction. The recess in which the guide is located can be covered by a liner. For both the front and back sections, a projection from a side panel of the proximal portion can fit into a linear recess 424 in the side panel of the distal portion. This can increase stability of the components.

A scissor link 430 secures the side panel of the front proximal portion 402 to the side panel of the back proximal portion 406, and a similar scissor link 432 secures the side panel of the front distal portion 404 to the side panel of the back distal portion 408, to provide expansion and contraction along the width direction.

This configuration can be combined with the various openings, e.g., zipper, flap, box clutch, etc., discussed above.

Although the embodiments described above focus on a clutch, the techniques could be applied to other types of handbags or carrying cases, such as briefcases or suitcases. Moreover, the techniques could be applied to other kinds of storage containers.

Although the implementations described above are expandable and collapsible along both their height and width, in some implementations, the clutch can be configured such that it is slidably expandable and collapsible along its height, but not along its width. For example, in the clutch 200 the inner cover 240 can be fixed to the inner railing 220 and the outer cover 280 can be fixed to the outer railing 260, rather than slidably attached. Similarly, in the clutch 300, the front inner rail 310 can be fixed to the back inner rail 330 and the front outer rail 320 can be fixed to the back outer rail 340, rather than slidably attached.

Similarly, in some implementations, the clutch 100 can be configured such that it slidably expandable and collapsible along its width, but not along its height.

A number of embodiments have been described. Nevertheless, it will be understood that various modifications may be made. Accordingly, other embodiments are within the scope of the following claims.

What is claimed is:

1. A handbag, comprising:

a box clutch, the box clutch comprising a cover assembly including first section providing a first side of the clutch and a second section providing an opposite second side of the clutch, wherein each of the first section and second section are shaped as substantially rectangular parallelepiped that is open on an interior side, the substantially rectangular parallelepiped including an outer face and four side walls extending inwardly from the outer face with inner edges of the side walls defining the open interior side, the first section hingedly connected to the second section at least along a bottom of the clutch that such that the clutch is openable at an opposite top side of the clutch and such that in a closed configuration the side walls of the first section and the second section contact at the edges, wherein each of the first section and second section have a length measured in a length direction parallel to an axis of rotation of the hinge, a width measured in a width direction perpendicular to the length and parallel to a side wall to which the hinge is attached, and a height measured in a height direction perpendicular to the length and width and parallel to the outer face along an axis parallel, wherein the first section includes a first proximal portion and a first distal portion slidably attached to the first proximal portion and positioned farther from the bottom of the clutch than the first proximal portion, the first distal portion slidably attached by a first bearing to the first proximal portion such that the first section is expandable away from and collapsible toward the bottom of the clutch, wherein the first proximal portion includes a first proximal inner wall and a first proximal outer wall that have a substantially same width, the first proximal inner wall and the first proximal outer wall providing a first rail, the first distal portion includes a first distal inner wall and a first distal outer wall, the first distal inner wall and the first distal outer wall providing a second rail, and the first bearing is configured such that one of the first and second rails fits and slides between another of the first and second rails, and wherein the second section includes a second proximal portion and a second distal portion slidably attached to the second proximal portion and positioned farther from the bottom of the clutch than the second proximal portion, the second distal portion slidably attached by a second bearing to the second proximal portion such that the second section is expandable away from and collapsible toward the bottom of the clutch, wherein the first bearing and second bearing are configured to provide parallel linear motion between the proximal portions and distal portions along the height direction.

2. The handbag of claim 1, wherein the first proximal portion comprises a first proximal side panel and a first proximal cover, and the first distal portion comprises a first distal side panel and a first distal cover.

3. The handbag of claim 2, wherein the first proximal side panel is slidable in a recess in the first distal side panel away from and toward the bottom of the clutch.

4. The handbag of claim 1, wherein the first distal portion and second distal portion are each slidably attached to the first proximal portion and second proximal portion, respectively, by a linear rail and track engagement.

5. The handbag of claim 1, wherein the first section is expandable and collapsible along a direction perpendicular to the first side of the clutch.

6. The handbag of claim 5, wherein the first section comprises a rail having a recess and a cover having a side wall that slidably fits into the recess.

7. The handbag of claim 1, wherein the first section is movable toward and away from the second section such that the clutch is expandable and collapsible along a direction perpendicular to the first side of the clutch.

8. The handbag of claim 1, wherein the first proximal portion, second proximal portion, first distal portion and second distal portion are generally rigid bodies.

9. The handbag of claim 8, wherein the first distal portion is slidable secured to the first proximal portion such that a rim the first distal portion remains flush with a rim of the first proximal portion as the first section expands and collapses.

10. The handbag of claim 1, wherein the first section includes a first inner portion and a first outer portion, and the second section includes a second inner portion and a second outer portion, and comprising a third bearing connecting the first inner portion of the first inner portion to the first outer portion and a fourth bearing connecting the second inner portion to the second outer portion, the third bearing configured to provide linear motion between the first inner portion and the first outer portion along a the width direction, the fourth bearing configured to provide linear motion between the second inner portion and the second outer portion along the width direction.

11. The handbag of claim 10, wherein the first bearing and second bearing are the same kind of bearing and the third bearing and the fourth bearing are the same kind of bearing.

12. The handbag of claim 11, wherein the first bearing is a different kind of bearing than the third bearing.

13. The handbag of claim 10, wherein the first and second bearings are placed along and secured to the middle of the first and second sections.

14. The handbag of claim 11, wherein the first bearing is a rail slide in which a side panel of one of the first proximal portion or first distal portion is slidable in a recess in the other of the first distal portion or first distal portion, the second bearing is a rail slide in which a side panel of one of the second proximal portion or second distal portion is slidable in a recess in the other of the second distal portion or second distal portion.

15. The handbag of claim 1, wherein the first proximal inner wall and the first proximal outer wall fit and slide between the first distal inner wall and the first distal outer wall.

16. The handbag of claim 1, wherein the first proximal inner wall and the first proximal outer wall are coupled together by a floor.

17. The handbag of claim 16, wherein the first proximal inner wall and the first proximal outer wall both extend perpendicularly from the floor.

* * * * *